US006848143B2

(12) United States Patent
Schneider

(10) Patent No.: US 6,848,143 B2
(45) Date of Patent: Feb. 1, 2005

(54) SCAVENGING METALLIC DEBRIS FROM BURIED METAL PIPELINES

(76) Inventor: John A. Schneider, 9572 SE. Bittern Way, Portland, OR (US) 97236

( * ) Notice: Subject to any disclaimer, the term of this patent is extended or adjusted under 35 U.S.C. 154(b) by 169 days.

(21) Appl. No.: 10/216,457

(22) Filed: Oct. 10, 2002

(65) Prior Publication Data

US 2004/0069322 A1 Apr. 15, 2004

(51) Int. Cl.[7] ..... B08B 9/00

(52) U.S. Cl. ..... 15/104.16; 15/104.068; 15/104.03; 15/104.05; 15/104.09; 15/104.095; 294/65.5; 134/6; 134/8; 134/22.1; 134/22.11; 134/42

(58) Field of Search ..... 15/104.16, 104.068, 15/104.03, 104.05, 104.09, 104.095; 294/65.5; 134/6, 8, 22.1, 22.11, 42

(56) References Cited

U.S. PATENT DOCUMENTS

| | | | | | |
|---|---|---|---|---|---|
| 2,734,767 | A | * | 2/1956 | Donham | 294/65.5 |
| 2,891,621 | A | * | 6/1959 | Walton et al. | 166/66.5 |
| 3,011,819 | A | * | 12/1961 | Moseley, Jr. | 294/65.5 |
| 6,312,138 | B1 | * | 11/2001 | Coleman, et al. | 362/120 |
| 2004/0069322 | A1 | * | 4/2004 | Schneider | 134/8 |

* cited by examiner

*Primary Examiner*—Sharidan Carrillo
(74) *Attorney, Agent, or Firm*—Jon M. Dickinson, P.C.; Robert D. Varitz, P.C.

(57) ABSTRACT

A metal-debris magnetic scavenging tool useable inside a buried, horizontal metallic pipeline through an access opening which has been cut into the upper wall portion of the pipeline overhead where the resulting debris has collected. A raiseable/lowerable and rotatable array of magnets, surface exposed, and operating moveably as a unit, agitate and collect debris principally within an area-footprint which allows for clearance lifting and removal of collected debris through the access opening.

6 Claims, 2 Drawing Sheets

SCAVENGING METALLIC DEBRIS FROM BURIED METAL PIPELINES

BACKGROUND AND SUMMARY OF THE INVENTION

This invention pertains to management of underground metal pipelines, such as underground gas pipelines. Very specifically, it relates to a method and apparatus for scavenging for removal metal debris of the kind which collects at the base of such a pipeline during and as a consequence of cutting into the pipeline for the purpose of installing various kinds of fittings. A preferred embodiment of the invention is described herein in the setting of a procedure known in the gas utility industry as a "tap a line stopper" procedure.

In a procedure of the type just generally identified above, when certain kinds of work needs to be performed on and with respect to a previously installed underground metal gas pipeline, a large, generally "circular" overhead access hole is appropriately cut into such a pipeline at a selected location for the purpose of installing a maintenance-related fitting. During such a procedure, metal debris falls down into and collects near the base of the pipeline immediately under where such an access hole is created. The debris which typically results includes a large chunk of metal referred to as a coupon which generally has the size and shape of the hole which has been cut, as well as smaller shavings and other shards of metal.

There are many reasons why it is important to remove, as effectively as possible, all such debris. Prior art approaches directed toward accomplishing debris scavenging and collecting have not been entirely and regularly successful. An unsuccessful removal procedure, often dictates the need to implement a significantly more expensive "clean-up" operation involving more cutting, and pipeline exposure digging. Today, where as in the past it was occasionally acceptable to leave debris in such a pipeline, a new kind of requirement exists which mandates that pipelines be clear for the passage of inspection devices. Such a mandate requires that, in substantially all instances where such metallic debris is created, it must essentially be thoroughly removed from a pipeline. Accordingly, it is very important today that there be a reliable and relatively inexpensive procedure for debris removal, and the present invention uniquely and very successfully addresses this issue.

According to a preferred embodiment of the invention, a novel scavenging tool is proposed which, fundamentally, employs magnetism for debris collection and removal. Included in this tool are (a) a somewhat pancake-shaped cylindrical tool body which is formed around a central axis as a body of revolution out of a soft-magnetic material, (b) an elongate tool stem which extends coaxially from one side, or face, of the tool body, (c) plural, angularly distributed, generally cylindrical sockets formed in the opposite face of the tool body, and disposed generally symmetrically about the central axis of the tool, and (d) plural, generally cylindrical, button-like, permanent magnets which fit snuggly within these sockets with their outwardly facing faces fully exposed, and somewhat recessed below the face level into which the sockets extend. A chamfered rim region which circumsurrounds the outsides of the magnet-receiving sockets is formed on the tool body.

The tool body and tool stem may be joined to one another in any suitable fashion, such as by bolt-joining, and the magnets are held in place in the sockets in a manner which causes them to operate completely as fixed units along with the tool body. Preferably, these magnets are held in place principally by the force of magnetic attraction which exists between them and the soft-magnetic material, typically steel, out of which the tool body is formed. Other manners of securement for the these magnets may be employed, such as adhesive bonding and/or screw attachment, but in most instances, magnetic attraction is entirely sufficient to stabilize the magnets securely within the sockets.

The fact that the outwardly facing faces of the installed magnets are exposed for viewing, so-to-speak, on that face of the tool body into which the receiving sockets are formed results in magnetic field lines existing in an outwardly bulging fashion into the air space immediately adjacent the exposed openings of the sockets. As a consequence, distributed generally angularly and somewhat circumferentially about the long axis of the tool, and adjacent the open ends of the sockets, there exists a kind of spatially undulating-strength, composite magnetic field which, with rotation of the tool about its long axis, and with respect to a magnetically attractable object which is nearby the exposed facial side of the magnets, produces what is referred to herein as a time-variant (in apparent strength) magnetic field.

Preferably, the largest outside diameter in the tool of this invention, and namely the largest outside diameter which characterizes the cylindrical tool body, is just somewhat less than the nominal diameter of a cut access opening (mentioned earlier) which is formed in a metal gas pipeline that is to be addressed by scavenging operation of the tool. With the mentioned chamfered rim region in existence on the tool body, according to the invention, the actual outer facial extremity of the tool body which exposes the magnets in the sockets has a diameter which is considerably less than that of the largest outside diameter in the tool body.

The various features and operating advantages of this tool will become very fully apparent, as will its capability of meeting the need expressed earlier herein, as the description which now follows is read in conjunction with the accompanying drawings.

DETAILED DESCRIPTION OF THE INVENTION

Figure 1:
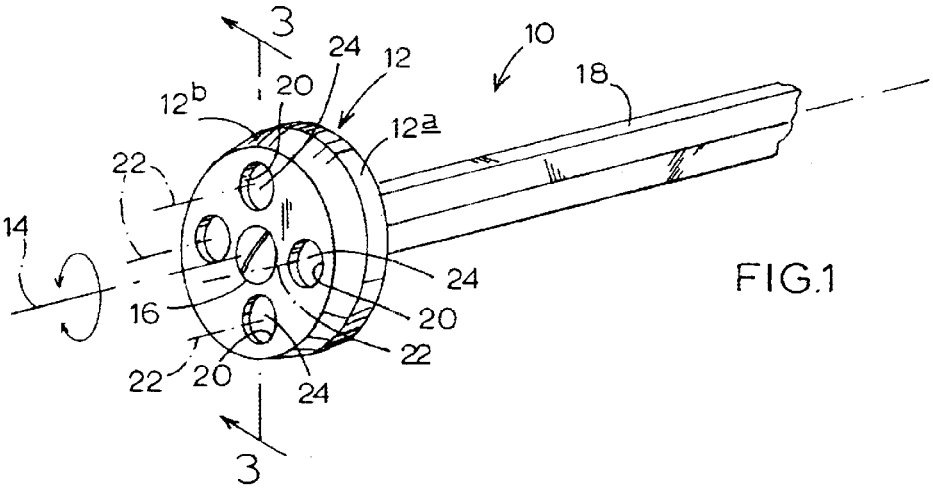
FIG. 1 is a fragmentary isometric view illustrating a preferred embodiment of a metal debris scavenging tool made in accordance with the present invention.
Figure 2:
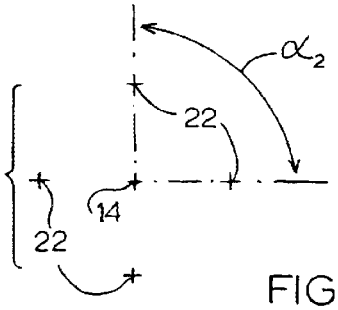
FIG. 2 is a simplified schematic diagram illustrating the relative positional (anglar and linear) locations in the tool of FIG. 1 that exist between certain generally parallel axes. These axes include the long central axis of the tool per se, as well as the respective axes of symmetry of several button-like (four) permanent magnets which are employed in this tool.
Figure 3:
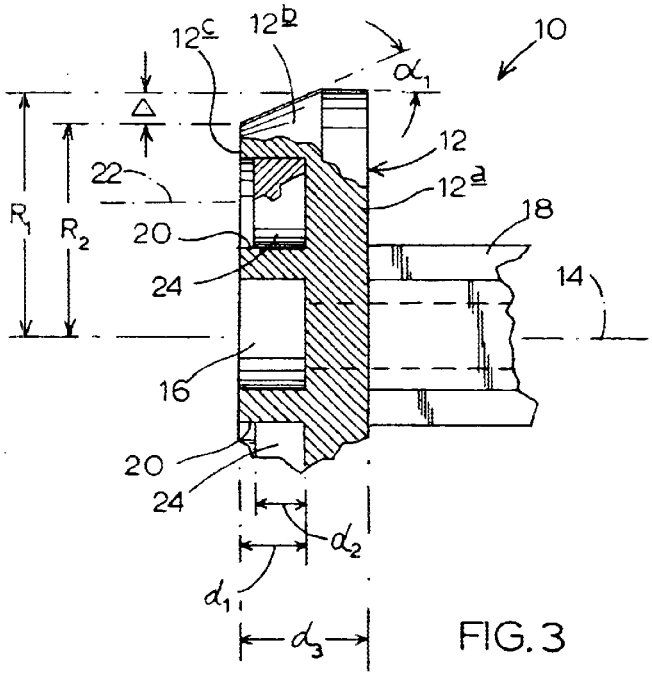
FIG. 3 is an enlarged, fragmentary, partly cross-sectioned view of the tool in FIG. 1, taken generally along the line 3—3 in FIG. 1.

Turning attention now to the drawings, and referring first of all to FIGS. 1–3 inclusive, indicated generally at 10 is a magnetic metal-debris scavenging tool constructed in accordance with the present invention. In general terms, tool 10 includes a somewhat pancake-shaped cylindrical tool body 12. Body 12 is a body of revolution that is centered on an axis of revolution shown by dash-dot line 14. It is made preferably of a soft-magnetic material such as steel. Suitably joined, as by a screw, such as the one shown at 16, coaxially with and to tool body 12 is an elongate tool stem 18.

Tool body 12, includes a generally fixed-diameter cylindrical interior-region portion 12*a* which joins with an inwardly tapering, chamfered, frustro-conical rim region 12*b* which generally faces toward the viewer in FIG. 1, and which is shown facing to the left generally in FIG. 3. As will become apparent, tool body 12 is constructed with dimensions that are especially suited for use of tool 10 for scavenging metal debris within a buried metal gas pipeline having a nominal inside diameter of about 4-inches. To this end, the large diameter, truly cylindrical portion, 12*a*, in tool body 12 has an outside diameter with a radius of curvature, shown at R1 in FIG. 3, of about 1.75-inches, with this diameter shrinking in size, progressing to the left along axis 14 in FIGS. 1 and 3, to a somewhat smaller overall outside diameter with a radius indicated at R2 in FIG. 3. The tool body has an axial thickness, shown at d3 in FIG. 3, herein of about 0.75-inches, and of this d3 dimension, the axial thickness of portion 12*a* (not specifically designated in the drawing figures) is about 0.25-inches, with the frustro-conical rim region 12*b* having an axial dimension (also not specifically designated in the drawings) herein of about 0.5-inches. As viewed in FIG. 3, the acute angle which the surface of frustro conical region 12*b* appears to make with axis 14, shown at $\alpha$1, is about 30-degrees.

The side, or face, 12*c* in the end region in tool body 12 which generally faces the viewer in FIG. 1, and which faces to the left in FIG. 3, is referred to herein as a generally planar end face which lies in a plane that is substantially normal to axis 14.

From the tool description which has been given so far herein, it will be seen that rim portion 12*b* intersects interior region 12*a* along a circular line having the radius R1, and intersects face 12*c* along another circular line having the radius R2.

Extending axially into, and opening to, face 12*c* herein, are four generally cylindrical sockets, such as those shown at 20, which are distributed angularly equally about axis 14 at the locations generally shown in the figures. Each of these sockets has a central long axis of symmetry, such as the axes shown at 22, which generally parallels previously mentioned axis 14. Each axis 22 lies at substantially the same radial distance from axis 14. Each of these sockets has a diameter herein of about 0.5-inches, and a depth (see d1 in FIG. 3) of about 0.375-inches. FIG. 2 schematically illustrates the relative spatial dispositions of axes 14 and 22. As can be seen in FIG. 2, and as was suggested earlier, from an angular disposition point of view, and as viewed in the plane of FIG. 2 which is normal to all of these axes, adjacent axes 22 lie, relative to axis 14, at angles with respect to one another which are less than 180-degrees, and very specifically herein, about 90-degrees. This angle is shown at $\alpha$2 in FIG. 2.

Placed and held by magnetic force within sockets 20 in tool body 12, are form-fitting, cylindrical-button magnets, such as those shown at 24 (an array). These magnets, which are of the "permanent type" are commercially available, and typically are made of robust magnetic material capable of exhibiting a relatively powerful magnetic field. The cylindrical central axes of magnets 24 are substantially co-aligned with socket axes 22. Each magnet has an axial dimension (see d2 in FIG. 3) of about 0.25-inches with a result that the outwardly facing ends, or sides, of the magnets are recessed slightly within those ends of sockets 20 which open to tool body face 12*c*. This condition of recess is clearly pictured in FIGS. 1 and 3.

Tool stem 18 herein has a generally hexagonal cross section, and may typically, with respect to tool 10 as such is now being described, have a length generally of about 8-inches. This is not a critical length.

As was mentioned above, tool 10, as pictured and dimensioned herein, is designed for use with respect to a buried pipeline having a nominal inside diameter of about 4-inches. Turning attention to FIGS. 4–8, inclusive, now along with FIGS. 1–3, inclusive, such a metal gas pipeline is shown generally at 28 in FIGS. 4 and 5. Especially with attention focussed on FIGS. 4, 5, 7 and 8, what is here being pictured with respect to pipeline 28 is a portion of a pipeline maintenance procedure referred to earlier herein as a "tap a line stopper" procedure. In particular, these several figures illustrate how tool 10 is employed to remove (scavenge) metal debris which has resulted from the cutting into the overhead portion of the wall in pipe 28 of an access opening, such as the access opening shown at 30 in FIGS. 4, 5, and 8.

Figure 4:
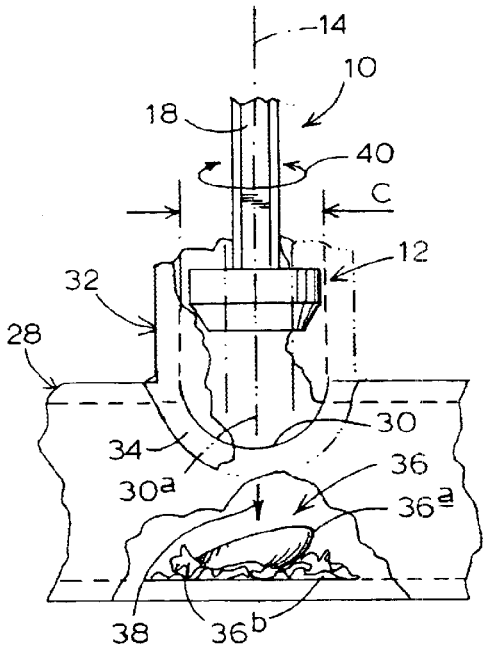
FIG. 4 is a somewhat smaller scale fragmentary side elevation, with portions of certain structures broken away to illustrate details of construction, showing the tool of FIG. 1 in use with respect to scavenging metallic debris from inside the base of a metallic gas pipeline which has been cut with an overhead access opening in the process of performing a procedure like that discussed earlier herein.

Access opening 30 has been prepared in a conventional cutting process employed by gas line maintenance people, after and before which cutting various additional fittings, such as the one shown very fragmentarily at 32 in FIG. 4, are (or may be) appropriately attached to pipe 28, as by welding. A weld joint which exists between pipeline 28 and fitting 32 is shown herein generally and fragmentarily at 34 in FIG. 4. Fitting 32 is generally cylindrical in nature, and matchingly circumsurrounds circular cut 30 which has the generally circular cross-sectional area footprint shown by dash-double-dot line 30 in FIG. 8. In pipeline 28, which nominally has an inside diameter of about 4-inches, access opening 30, as such is pictured in FIG. 8, has a nominal diameter of about 3.75-inches.

The cutting procedure by way of which access opening 30 was produced has resulted in the creation of a collection of metal debris 36 adjacent the base of pipeline 28, directly beneath access opening 30. As illustrated in FIG. 4, debris 36 includes one singular large chunk 36*a*, referred to as a coupon, and a collection of smaller shavings/shards such as those pointed to in FIG. 4 at 36*b*. Coupon 36*a*, generally speaking, takes the form of the major piece of metallic pipeline which once substantially filled access opening 30.

It is to enable easy and substantially complete removal of debris 36 herein that tool 10 has been designed.

In any suitable manner not especially relevant to the present invention, tool 10, through its tool stem 18, is appropriately joined to a power-driven rotary machine (not shown), and is securely positioned so as to be diametrally lowerable into pipeline 28 via access opening 30 with the axis of revolution of tool 10 being substantially coincident with this opening's central axis shown by a dash-double-dot line 30*a* in FIG. 4. Very specifically, pre-use positioning of tool 10 is such that vertical movement of the tool, during its use, along axis 14, will result in the large diameter portion of body portion 12*a* freely clearing the inside of fitting 32, as well as also clearing the side margins of circular access opening 30. This is the condition in which tool 10 is shown in FIG. 4 prior to this tool's being introduced downwardly into the interior of pipeline 28.

With respect to, now, to the scavenging of debris 36 by tool 10, the tool is appropriately lowered downwardly through opening 30 to a region immediately above debris 36, as is indicated generally by arrow 38 in FIG. 4. As can be seen especially well in FIG. 5, the chamfered rim region 12*b* of tool body 12 allows this tool body to be lowered quite deeply toward and into the base region of pipe 28.

Figure 5:
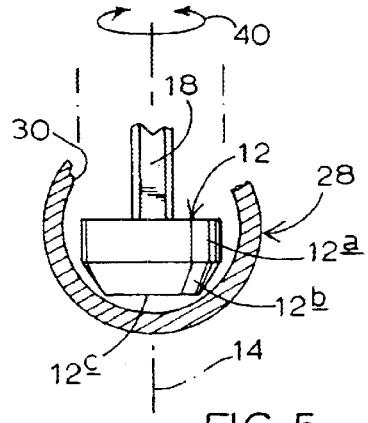
FIG. 5 is a view, on a slightly smaller scale than that which is employed in FIG. 4, and which is fragmentary in nature, illustrating, from a point of view which is taken along the long axis of the pipeline of FIG. 4, showing how the chamfered rim region of the tool body in the tool of this invention disposes itself within the cross-sectional area of that pipeline.
Figure 6:
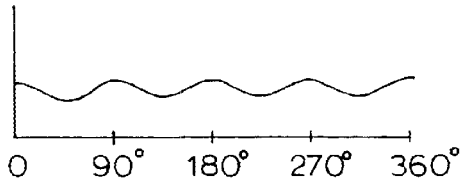
FIG. 6 is a graphical illustration picturing, very generally, what was referred to herein earlier as a kind of undulating magnetic field distribution which extends somewhat circumferentially about the tool's long axis, and exposed on that end of the tool which generally faces the viewer in FIG. 1.

With tool 10 thus lowered, the power-drive mechanism attached to it, mentioned above, is operated, bidirectionally if desired, to produce rotation of tool 10 about its axis of revolution 14. Such bidirectional rotation is indicated in FIGS. 4 and 5 by double-ended curved arrow 40.

By virtue of the fact that the four magnets, 24, which are included in tool 10, are outwardly exposed through the recessed regions in sockets 20 which open to face 12*c*, a kind of angularly undulating, spatial magnetic field distribution exists, which, with rotation of the tool as indicated by arrow 40, causes beneath the tool, and at each stationary region within pipeline 28 which is faced by downwardly facing face 12*c*, the experience of a time-variant magnetic field strength. Field strength distribution is suggested generally by the graphical image presented in FIG. 6. Peaks and valleys in this undulating field strength relate to the relative quadrature dispositions of exposed magnets 24, distributed, as was previously described, generally at angular positions around axis 14 which are about 90-degrees apart.

Figure 7:
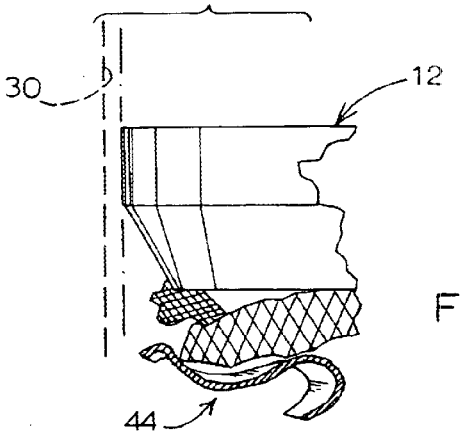
FIG. 7 is a much enlarged fragmentary diagram illustrating how debris collected by the tool of this invention is generally acquired and retained for withdrawal from within a pipeline. Specifically, this figure suggests how, generally speaking, the "perimetral outline" of collected debris normally lies within what can be though of herein as the generally circular footprint of the cross-sectional area of an access opening which has been cut into a pipeline, such as into the pipeline shown in FIGS. 4 and 5.
Figure 8:
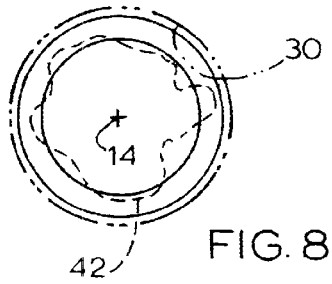
FIG. 8 aids FIG. 7 in picturing a gathered-debris perimetral outline.

As a consequence, now, of lowering of tool 10 downwardly toward debris 36, and as is aided by modest rotation of the tool about its axis of revolution, a significant debris gathering activity takes place, whereby the metallic debris pictured at 36 is effectively moved and gathered to become magnetically caught on the underside of tool body 12, closely adjacent one or more of magnets 24. Because of the presence of chamfered region 12*b* in tool body 12, metallic debris is generally gathered in such a fashion that its outside gathered perimetral outline will, under most circumstances, lie generally within the axially viewable footprint (see FIG. 8) of opening 30. In FIG. 8, a stylized perimeter outline for such collected debris is shown generally by dashed line 42. FIG. 7 also generally illustrates this situation where pieces of collected debris, magnetically held beneath tool face 12*c*, are shown generally at 44.

It should be understood that not in all circumstances will tool rotation be required for proper collecting and removal of all debris.

The invention thus proposes a novel and very capable, simple to construct and use metal-debris-scavenging tool. The distributed spread of facially exposed magnets, enabled to be rotated as described above, to operate as a unit (non-relatively-moveable) with the tool body and stem, and to be capable of introducing a time-variant magnetic field in the zone of debris collection, offers a highly successful apparatus and procedure for removing metallic debris from metal pipelines.

While a preferred embodiment of and manner of practicing the invention have been described herein, variations and modification which come within the scope of the invention are certainly possible.

I claim:

1. A tool for scavenging magnetic metal debris from the inside of an elongate, generally horizontal, cylindrical, metal pipeline, which debris is generally located in the base of the pipeline beneath an access opening which has been cut in the wall of the pipeline comprising:

an elongate, generally cylindrical tool body of revolution having an axis of revolution, and an end region disposed along said axis, said tool body being freely insertable into, and withdrawable from, the interior of the pipeline through the access opening, said end region including a generally planar end face which lies substantially normal to said axis, plural, elongate sockets having long axes, and extending into said tool body with their respective long axes generally paralleling said tool body's axis of revolution, said sockets opening to said face at plural, spaced locations distributed angularly about said axis of revolution, and plural, permanent magnets secured in a recessed fashion, and one each, within said sockets for behavior as a unit with said tool body, each of said magnets being outwardly exposed where its associated socket opens to said face.

2. The tool of claim 1, wherein, said end region in said tool body is formed with a chamfered, generally frustroconical rim region extending in a radially outwardly diverging manner from the plane of said face toward an interior region in said tool body.

3. The tool of claim 1, wherein the angular spacing which exists between adjacent sockets is less than 180-degrees.

4. The tool of claim 1, wherein said magnets are held in said sockets by a force of magnetic attraction between the magnets and said tool body.

5. The tool of claim 1 which further comprises an elongate, rigid, tool stem, and said tool body is anchored generally coaxially to the end of said tool stem, said tool stem enabling rotation of the tool body and magnets about the tool body's said axis of revolution.

6. The tool of claim 2, wherein said chamfered rim region intersects said face along a generally circular line having one radius, and terminates adjacent said interior region along another circular line having another radius which is greater that said one radius.

* * * * *